US008006339B1

(12) United States Patent
Bennett

(10) Patent No.: US 8,006,339 B1
(45) Date of Patent: Aug. 30, 2011

(54) PREFABRICATED ARTICULATING PIER CAP

(76) Inventor: Jeffery W Bennett, Hendersonville, TN (US)

( * ) Notice: Subject to any disclaimer, the term of this patent is extended or adjusted under 35 U.S.C. 154(b) by 396 days.

(21) Appl. No.: 12/412,545

(22) Filed: Mar. 27, 2009

(51) Int. Cl.
*E01D 19/02* (2006.01)
*E01D 19/04* (2006.01)

(52) U.S. Cl. ..... 14/73.5; 14/75; 384/36

(58) Field of Classification Search ..... 14/32, 73, 14/73.5, 75; 384/36
See application file for complete search history.

(56) References Cited

U.S. PATENT DOCUMENTS

| | | | | | |
|---|---|---|---|---|---|
| 2,945,248 | A | * | 7/1960 | Meagher et al. | 14/73.5 |
| 3,243,236 | A | * | 3/1966 | Graham | 384/36 |
| 3,329,472 | A | * | 7/1967 | Donnellan et al. | 384/36 |
| 3,397,016 | A | * | 8/1968 | Delforce et al. | 384/36 |
| 3,703,014 | A | * | 11/1972 | Koester | 14/73.5 |
| 3,971,598 | A | * | 7/1976 | Rudge | 384/36 |
| 4,320,549 | A | * | 3/1982 | Greb | 14/73.5 |
| 5,072,474 | A | | 12/1991 | Dilger et al. | |
| 5,231,931 | A | | 8/1993 | Sauvageot | |
| 5,437,072 | A | | 8/1995 | Dinis et al. | |
| 5,597,239 | A | * | 1/1997 | Scaramuzza et al. | 384/36 |
| 5,597,240 | A | * | 1/1997 | Fyfe | 384/36 |
| 5,771,518 | A | | 6/1998 | Roberts | |
| 5,853,001 | A | | 12/1998 | Vyprachticky | |
| 6,449,791 | B1 | | 9/2002 | Vodicka | |
| 6,568,019 | B2 | | 5/2003 | Marketz | |
| 6,795,992 | B2 | | 9/2004 | Marketz | |
| 6,971,795 | B2 | * | 12/2005 | Lee et al. | 384/36 |

OTHER PUBLICATIONS

"Prefabricated Bridge Elements and Systems," Priority, Market-Ready Technologies and Innovations, U.S. Department of Transportation, Federal Highway Administration, FHWA-HRT-04-075 HRTS-03/01-04(1M)E.

"Get In, Get Out, Stay Out," Prefabricated Bridge Elements and Systems, Bridge Technology, US Department of Transportation, Federal Highway Administration, http://www.fhwa.dot.gov/bridge/prefab/.

"Implementation Panel Members," Prefabricated Bridge Elements and Systems, Bridge Technology, US Department of Transportation, Federal Highway Administration, http://www.fhwa.dot.gov/bridge/prefab/members.htm.

* cited by examiner

*Primary Examiner* — Gary S Hartmann
(74) *Attorney, Agent, or Firm* — Waddey & Patterson, P.C.; Phillip E. Walker

(57) ABSTRACT

The present disclosure provides a support structure for a transportation passageway supported by a column. The support structure includes a bearing, a bracket and a cap. The bearing includes an anchor, a bracket base, and a bearing axis of rotation. The anchor is shaped to fix the bearing to the column. The bracket includes a column face and an arcuate face. The column face is shaped to rotate about the bearing axis of rotation relative to the bracket face of the bearing. The cap includes a top and a bottom wherein the top includes at least one beam support and the bottom includes an arcuate bottom portion. The arcuate bottom portion is shaped to accept the arcuate face of the bracket and includes a radial center point that defines a cap axis of rotation. The arcuate bottom portion is shaped to rotate about the radial center point relative to the arcuate face.

20 Claims, 6 Drawing Sheets

PREFABRICATED ARTICULATING PIER CAP

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to a support structure for a transportation passage way, and more specifically, but not by way of limitation, to a support structure, such as a pier, for a transportation passageway, such as a road or a bridge, that is supported by a column.

The major forms of transportation in the United States occurs either in vehicles on roads or in trains on railways. In the case of roads, numerous highways and interstates form an integral part of the routine of most Americans and their travels on a daily basis. With these extensive roadways that span throughout the United States, construction items such as bridges, overpasses, on-ramps, exit-ramps and the like are required for the roads to traverse the landscape and complete the roads connecting the various destinations of travelers.

Of course, these roads, bridges, overpasses and associated structures must be built and then maintained in order to provide a safe passageway for the traveling public. Under conventional methods, the highway interstate construction can be very disruptive to the traveling public. This is typically due to the sequential construction methods of the various bridges and overpasses, and similar structures. Typically, the order of construction includes the foundations first, columns second, piers third, then the beams and/or decks next. The road, or alternate structure such as train tracks, that will ultimately be traveled is then finally positioned.

The typical construction has the foundations, columns, and caps made of concrete. This requires a framework to support and to contain the concrete as it solidifies once it is poured. This method results in long construction times since the various frameworks must be first built. Then the actual structure such as the column and/or cap must be poured into place and allowed to set. Next the framework must be removed to facilitate traffic flow, especially around the columns.

Recent construction methods, including those proposed by the Federal Highway Administration of the U.S. Department of Transportation have focused on pre-fabricated bridge elements. These are typically comprised of concrete and are manufactured either at the building site or off-site under controlled conditions. The purpose of the pre-caste nature is to reduce the framework required during building of the bridge and/or overpass in order to increase the safety of the workers during the construction, reduce the traffic disruption to nearby roadways and lessen the overall footprint during construction and the impact on insular items of that footprint such as power lines, the buildings, etc.

Most of the pre-fabrication aspects of these bridges and overpasses have previously focused on providing segments of the bridge or overpass that are designed to exact specifications needed for the particular bridge and/or overpass. Current pre-fabricated components do not lend themselves to flexible designs. These current designs lack the capability fore any substantive adjustment post manufacturing, including at the construction sight. As such, the current pre-fabricated components require extensive planning during the early stages of the projects. Additionally, exact measurements for these sections must be predetermined and those sections must be manufactured to those certain measurements and specifications in order for the roadway to be properly built. This has two major drawbacks.

First, little to no adjustment can be made at the construction site if those measurements and specifications are wrong. As such, sections of those piers are sometimes wasted because they did not fall into the proper dimensions for the roadway being built. Additionally, given the precise nature of the construction of those piers, installation can be very tedious in order to properly position those prior art piers.

The second drawback to this sort of construction is the fact that each pier, bridge section, or overpass section must be individually constructed per the specifications for that particular section of transportation passageway. As such, little if any mass production of the piers for the transportation passageway can be made in advance. This effectively substantially eliminates mass production of the piers which slows the overall construction time down for the transportation passageway project.

Thus, there is a need in the art for a prefabricated support structure used to support a transport passageway that can be quickly manufactured and allows for adjustment to match the required transportation passageway requirements at the construction site.

BRIEF SUMMARY OF THE INVENTION

The present disclosure provides a support structure for a transportation passageway supported by a column. The support structure includes a bearing, a bracket and a cap. The bearing includes an anchor, a bracket base, and a bearing axis of rotation. The anchor is shaped to fix the bearing to the column. The bracket includes a column face and an arcuate face. The column face is shaped to rotate about the bearing axis of rotation relative to the bracket face of the bearing. The cap includes a top and a bottom wherein the top includes at least one beam support and the bottom includes an arcuate bottom portion. The arcuate bottom portion is shaped to accept the arcuate face of the bracket and includes a radial center point that defines a cap axis of rotation. The arcuate bottom portion is shaped to rotate about the radial center point relative to the arcuate face.

The bearing axis of rotation and a cap axis of rotation can be skewed. Alternately, the bearing axis of rotation and a cap axis of rotation can be perpendicular. Additionally, the at least one beam support can include a curved surface that defines a center of rotation that is perpendicular to both the bearing axis of rotation and the cap axis of rotation.

The cap, bracket and bearing can be composed of metal. The structure can further include a fastener and the cap can include an attachment opening. The bearing can include a post having a stanchion shaped to traverse the attachment opening and engage the fastener to secure the cap to the bearing. The bracket can be between the cap and the bearing when so assembled. The cap can also be welded to the bracket while the bracket can operatively be welded to the bearing.

The bracket can further include at least one pilot pin while the bearing can include at least one pilot hole shaped to accept the at least one pilot pin. A spacer can be positioned between the bracket and the bearing to space the bracket from the bearing. The cap can include a width and a length. The length can have a mid-point wherein the radial center point of the arcuate bottom of the cap is substantially aligned with the mid-point of the length of the cap.

Accordingly, it is an object of the present invention to provide an improved support structure for a transportation passageway.

Another object of the present invention is to provide a pier for supporting a transportation passageway on a column.

An alternate object of the present invention is to provide a pier for supporting a transportation passageway that is pre-constructed yet can be adjusted during construction of the passageway in order to align the transportation passageway.

Still another alternate object of the present invention is to provide a pier for supporting a transportation passageway on a column such that the pier has multiple axes about which the pier can be adjusted during the assembly of the pier at a construction site for the transportation passageway.

Numerous other objects, features and values of the present invention will be readily apparent to those skilled in the art, upon reading of the following disclosure, when taken into conjunction with the accompanying drawings.

DETAILED DESCRIPTION OF THE PREFERRED EMBODIMENTS

Figure 1:
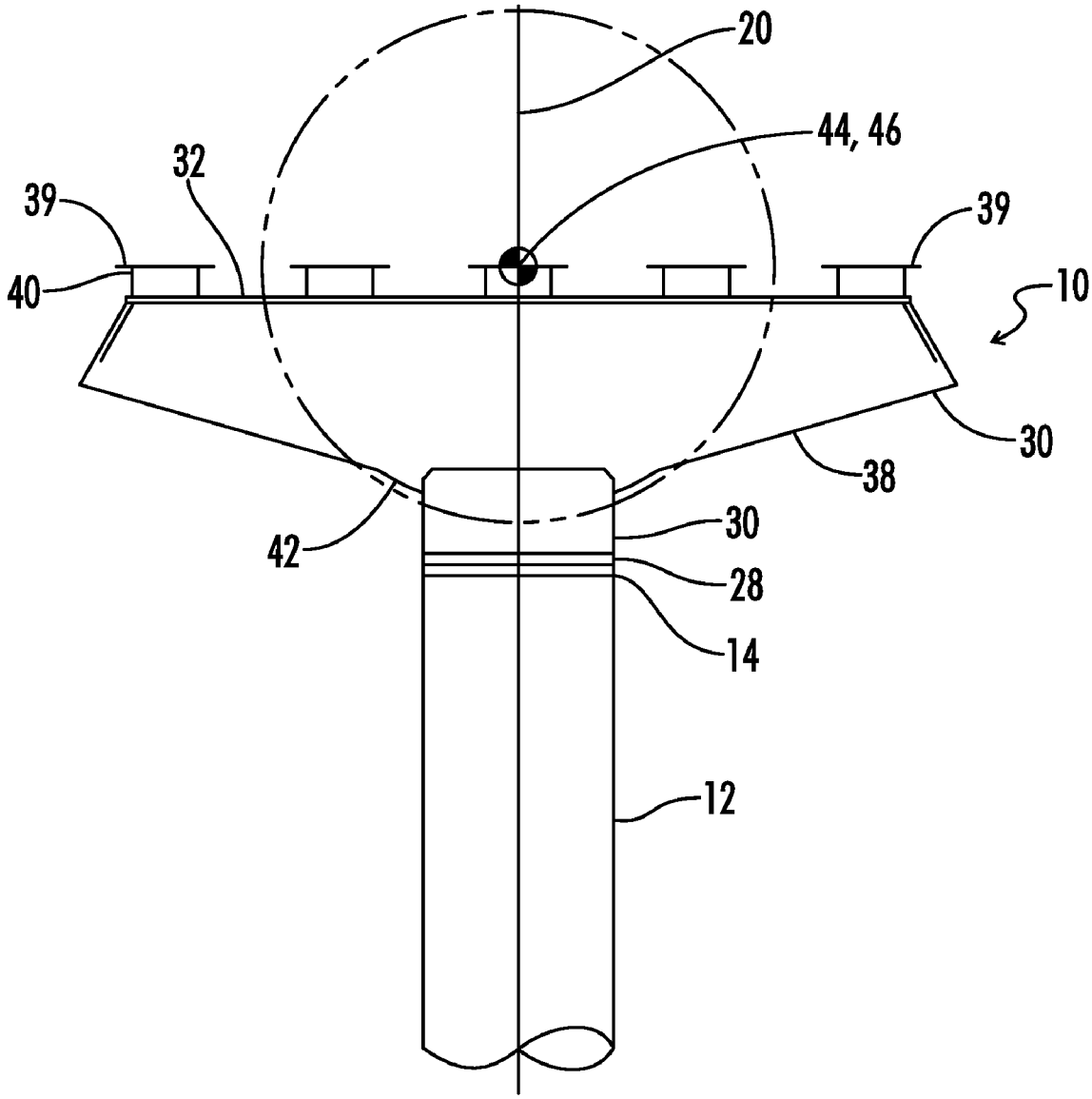
FIG. 1 is a front view of a support structure made in accordance with the current disclosure.
Figure 5:
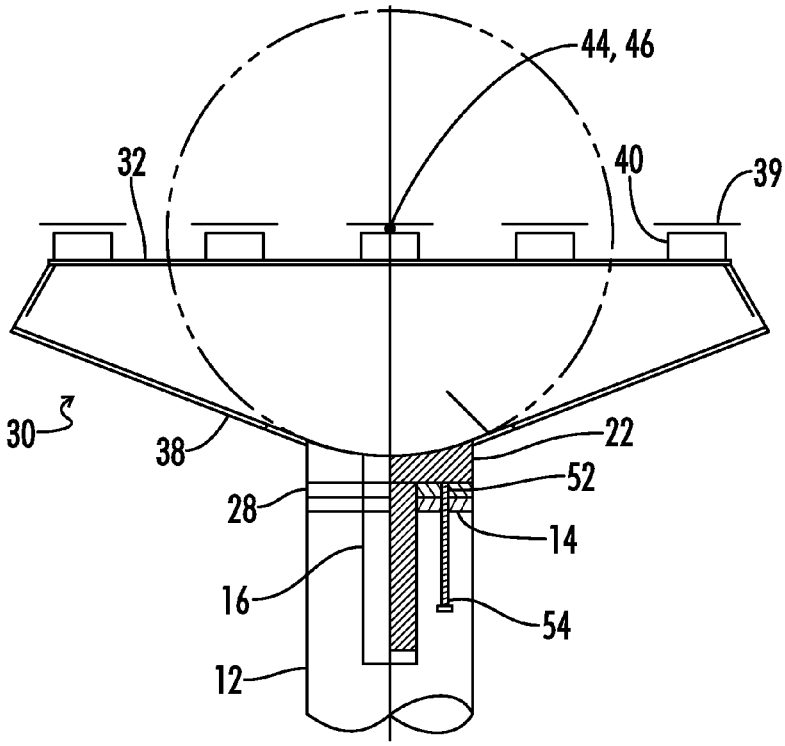
FIG. 5 is a partial cutaway front view of a support structure made in accordance with the current disclosure.
Figure 2:
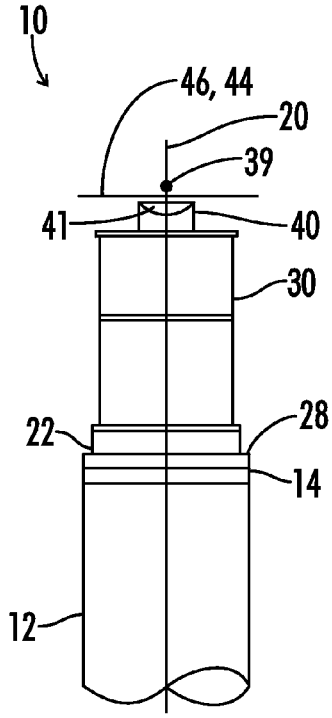
FIG. 2 is a side view of a support structure made in accordance with the current disclosure.
Figure 3:
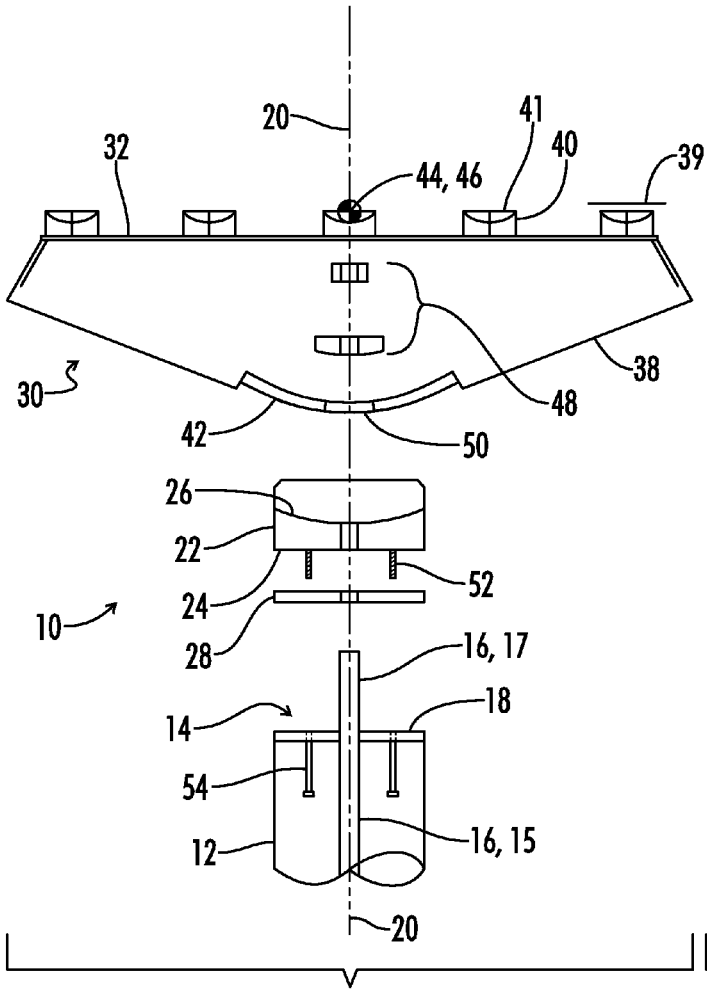
FIG. 3 is an expanded front view of a support structure made in accordance with the current disclosure.
Figure 4:
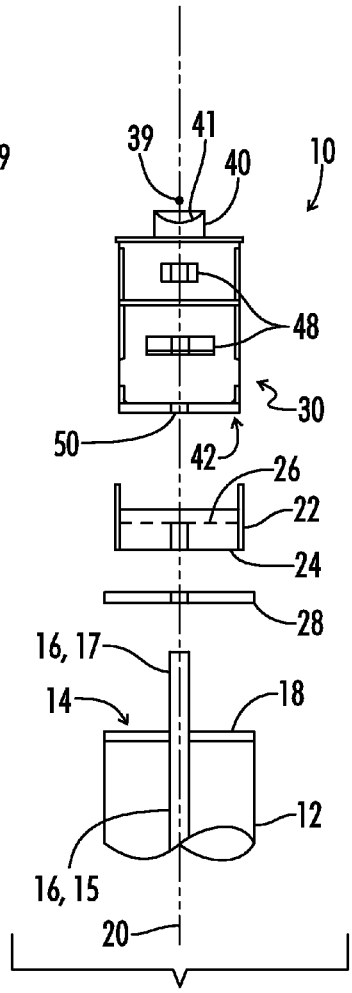
FIG. 4 is an expanded side view of a support structure made in accordance with the current disclosure.
Figure 6:
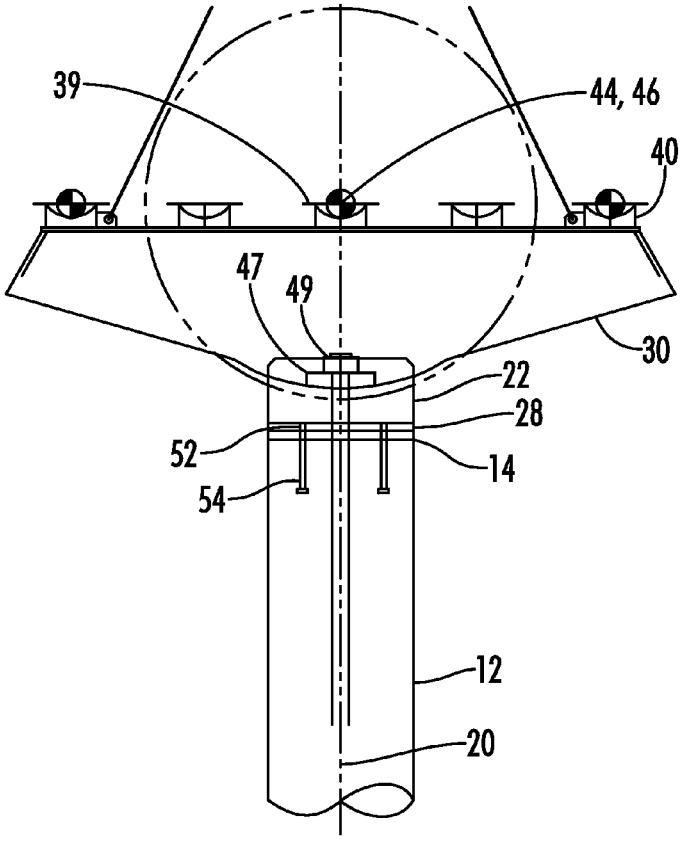
FIG. 6 is a partial front view of a support structure made in accordance with the current disclosure.
Figure 7:
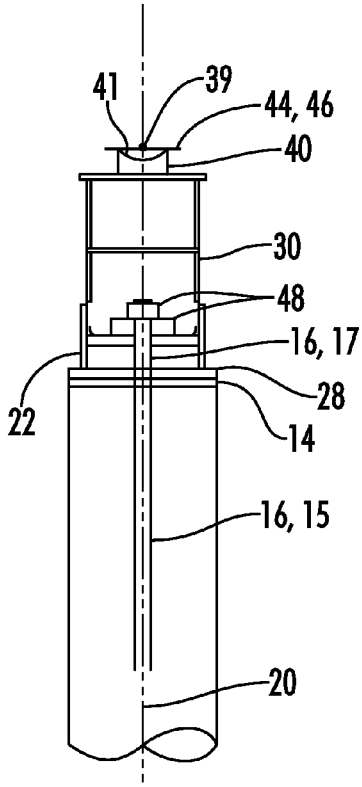
FIG. 7 is a side partial cutaway view of a support structure made in accordance with the current disclosure.

Referring now generally to the drawings, a support structure 10 for a transportation passageway 11 supported by column 12. The transportation passageway 11 can be various transportation passageways including, those passageways traveled by automobiles, trains, and the like. For example, the transportation passageway can be a bridge, overpass, on-ramp, exit ramp, viaduct, raised rail, and the like about which such items as vehicles, automobiles, trains, and the like traverse.

The support structure 10 comprises a bearing 14, bracket 22, and cap 30. The bearing 14 includes a post 16, which can also be described as a stanchion 16, having an anchor side 15. The bearing 14 includes a bracket face 18 and a bearing axis of rotation 20. The anchor 15 is shaped to fix the bearing 14 to the column 12. The anchor 15 can be positioned in a column 12 and the column 12 can be cast around the anchor 15 to secure the bearing 14 to the column 12.

Figure 8:
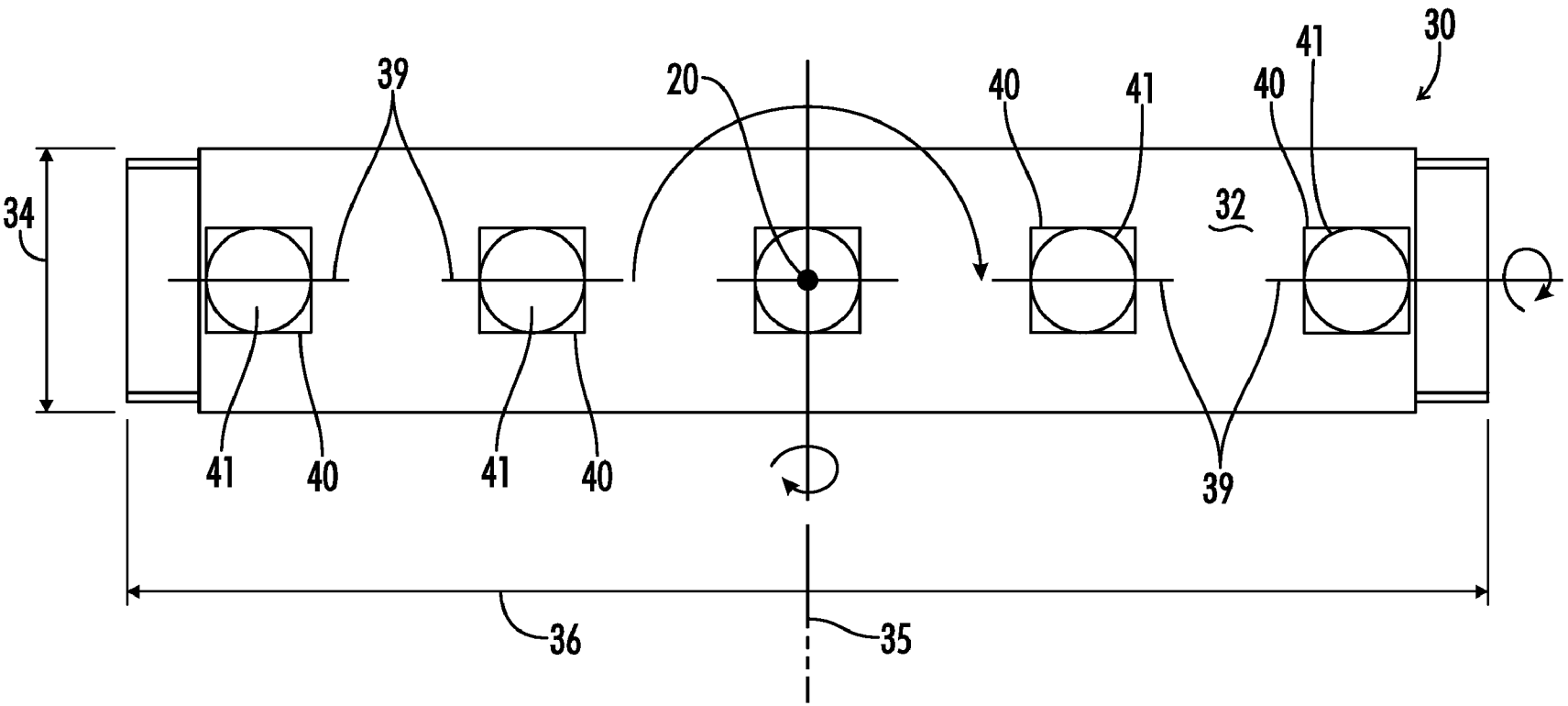
FIG. 8 is a top view of a support structure made in accordance with the current disclosure.

The bracket 22 includes a column face 24 and an arcuate face 26. The column face 24 is shaped to rotate about the bearing axis of rotation 20 relative to the bracket face 18. The cap 30 includes a top 32, width 34, length 36, and bottom 38. The top 32 includes at least one beam support 40 while the bottom 38 includes an arcuate bottom portion 42. The arcuate bottom portion 42 is shaped to accept the arcuate face 26 of the bracket 22 and includes a radial center point 44 defining a cap axis of rotation 46. The arcuate bottom portion 42 is shaped to rotate about the radial center point 44, and associated cap axis of rotation 46, relative to the arcuate face 26 of the bracket 22. The beam support 40 can include a curved surface 41 defining a center of rotation 39. The curved surface 41 can include a spherical seat as seen in FIG. 8. The length 36 of the cap 30 can include a mid-point 35 wherein the radial center point 44 of the arcuate bottom portion 42 can be substantially aligned with the mid-point 35.

The bearing axis of rotation 20 and cap axis of rotation 46 can be skewed relative to one another. Alternately, the bearing axis of rotation 20 and the cap axis of rotation 46 can be perpendicular to one another. Additionally, the center of rotation 39 of the beam support 40 can be perpendicular to both the bearing axis of rotation 20 and the cap axis of rotation 46. The bearing axis of rotation 20, center of rotation 39, and cap axis of rotation 46 can be described as a first axis of rotation 20, second axis of rotation 39 and third axis of rotation 46, respectively.

Figure 9:
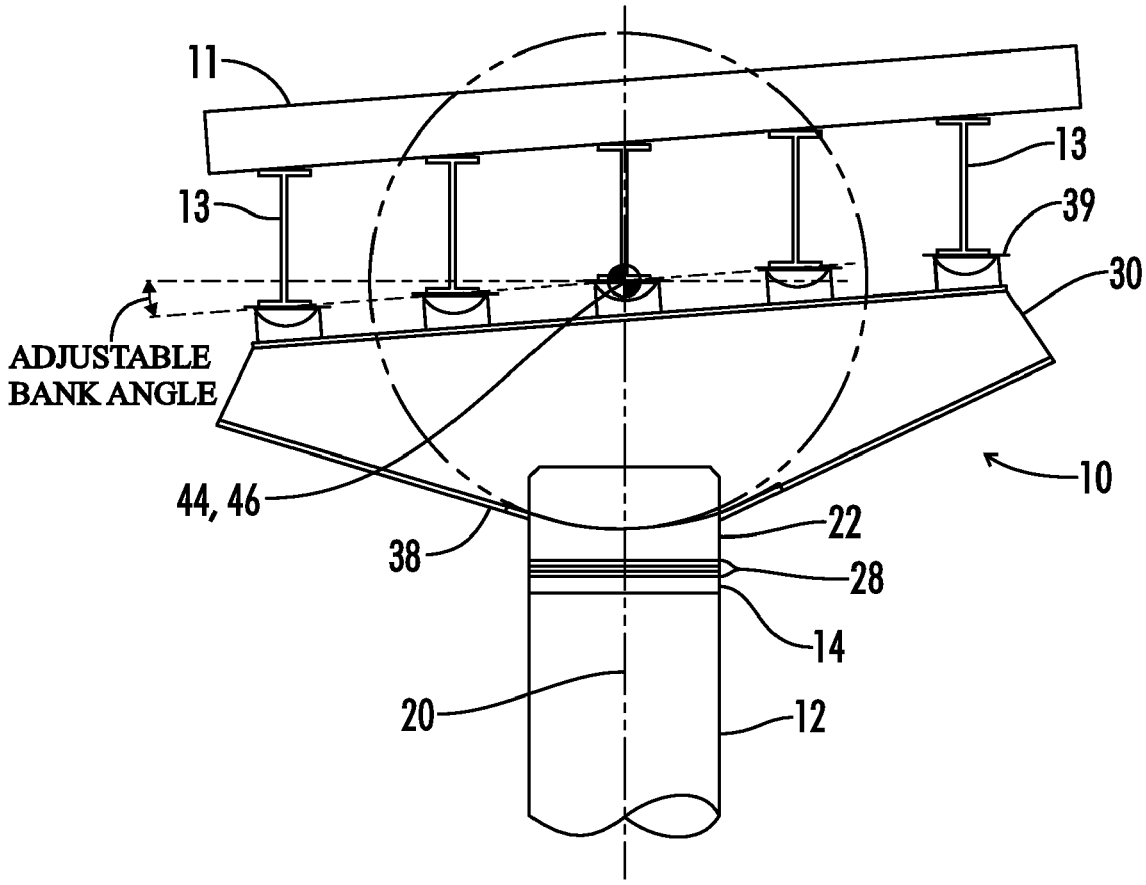
FIG. 9 is a front view showing an adjustment of a support structure made in accordance with the current disclosure.

As best seen in FIG. 9, the three axes of rotation 20, 39, and 46 allow adjustment of the support structure 10 on the column 12 in order to allow alignment of the transportation surface. Each axis 20, 39, and 46 can be perpendicular to the other two axes to allow adjustment of the transportation passageway 11 in three individual planes. As such, the support structure 10 can be prefabricated, taken to a construction site, positioned on the column 12 and then adjusted in those three planes, with the aid of the beams 13, to align the transportation passageway 11 as required to facilitate movement of the vehicles and/or trains across that passageway 11. Alternately described, the support structure 10 allows adjustments in the roll, pitch, and yaw of the transportation passageway 11 to align the angle, bank, slope, and other features of the transportation passageway 11 as required for proper design of that passageway 11.

The support structure 10 can further include a spacer 28 that can be positioned between the bracket 22 and the bearing 14 to space the bracket 22 from the bearing 14. This additional spacing can facilitate an overall adjustment in the height of the transportation passageway as needed for proper construction of such passageway. As such, the combination of the support structure 10 and the spacer 28 facilitates adjustability of the transportation passageway 11 in a fourth direction. Alternately, this dimension can be altered by varying the thicknesses of the materials with which the support structure 10 is comprised. For example, the bearing 14 and/or bracket 22 can be comprised of materials with desired thicknesses to adjust the overall verticality of the transportation passageway.

Various portions of the support structure 10 can be comprised of metal including the cap 30, bracket 22, bearing 14, and/or the spacer 28. This facilitates welding of the cap 30 to the bracket 22 and welding of the bracket 22 to the spacer 28 and/or bearing 14.

To further facilitate assembly of the support structure 10, a fastener 48 can be included. This fastener 48 can be things known in the art such as a washer 47 and nut 49. The bearing 14 can include a stanchion 17, for example as part of the post 16 which can be described as a fastener side of the post 16, shaped to traverse an attachment opening 50 in the cap 30. This stanchion 17 can engage the fastener 48 to secure the cap 30 to the bearing 14 while securing the bracket 22 between the cap 30 and the bearing 14.

The bracket 22 can further include at least one pilot pin 52 that corresponds to at least one pilot hole 54 in the bearing 14 that is shaped to accept the pilot pin 52. The pilot pin 52 and pilot hole 54 can further facilitate positioning of the bracket 22 and bearing 14 to reduce construction time of the support structure 10. For example, the pilot hole 54 can be formed into the column 12 to further facilitate the attachment between the bearing 14 and the column 12.

The bracket face 18, column face 24, and spacer 28 can be substantially flat in shape to facilitate positioning of the bracket 22 relative to the bearing 14 and the overall vertical placement of the transportation passageway 11 without unduly altering the alignment and positioning of that passageway 11.

In operation, the support structure 10 can be implemented as follows. For any given transportation passageway 11, it will be known that a pier and column combination will be preferred to support that transportation passageway, such as a road, via a bridge, overpass, viaduct and the like. As such, embodiments as disclosed herein can be provided. Namely, a bearing having a first axis of rotation, a bracket having an arcuate face, and a prefabricated pier cap having a second axis of rotation and beam supports having a third axis of rotation can be provided.

The structures that are currently being used as supports between conventional pier caps and the pathway surface, which can generally be referred to as beams, can also be provided. These can be provided at a construction site. A column that shall support the pier, and ultimately the transportation passageway, can be pre-constructed to a desired height at the construction site.

The construction process can be continued by fixing the bearing on the column about the first axis of rotation in an effort to align the transportation passageway. Next, the bracket can be positioned on the bearing and the prefabricated pier cap can be positioned on the bracket. Depending on the particular passageway configuration, the construction of the pier can continue with optional independent adjustment of the bracket about the first axis of rotation to facilitate alignment of the transportation passageway. Additionally, the prefabricated pier cap can be optionally and independently adjusted about the second axis of rotation again to align the transportation passageway.

Once the pier cap and bracket are positioned as desired, the aforementioned beams can be positioned on the prefabricated pier cap. Then those beams can be optionally and independently adjusted about the third axis of rotation to align the transportation passageway as needed. Alternately during the process, spacers can be positioned between the bracket and column to adjust the vertical positioning of the prefabricated pier cap, and ultimately the transportation passageway, in relation to the column and the surface, such as the ground, alternate roadway, water, and the like, over which the transportation passageway is supported.

As such, a support structure 10 constructed as disclosed herein can be mass produced and designed to have multiple adjustment features that can ultimately alter the positioning, location, etc. of the transportation pathway as needed to facilitate movement of items, such as vehicles, trains, and the like across that passageway. As previously mentioned, a support structure 10 so constructed includes improvements over traditional construction supports in such areas as decreased production time, decreased construction time, decreased cost and increased adjustability at the construction site to facilitate proper positioning of the transportation passageway across the column and pier by which the transportation passageway is supported.

Additionally, improvements of embodiments of the current disclosure over prior art include increased safety in construction while still providing an increased flexibility verses convention cast in place construction or current precast construction. The current embodiments can reduce the total construction time of the project as items can be fabricated off site while the foundational work is proceeding at the construction site. These prefabricated items can be transported to the site by conventional transportation methods—truck, train, etc. Additionally, multiple embodiments can be used side by side to attain wider width passageways at the construction site with a reduced disruption to the area surrounding the construction site. The embodiments lend themselves to the use of conventional fabrication and machining processes currently in use in heavy machinery, shipping and bridge building operations.

The current embodiments can be prefabricated with metal or a combination of metal and concrete materials and can be manipulated at the construction site of the pathway by the use of known mechanical or hydraulic devices. This on site manipulation can include alignment coincident with predetermined set points by the use of conventional surveying methods and equipment. Alignment between multiple piers, or pier to pier alignment, can be achieved with two set points, or reference points, on each pier cap. For example, a point at the center of rotation and a point at an end of the cap for each pier cap can be used to alignment subsequent pier caps that will support the transportation pathway. This alignment flexibility is supported by the embodiments exhibiting four degrees of freedom including yaw, pitch, roll and vertical displacement.

The current embodiments can also be adorned with a variety of custom esthetic features as desired by the manufacturer or principality to provide an alternative to the traditional cast concrete or metal facade.

Thus, it is seen that the Prefabricated Articulating Pier Cap readily achieves the ends and advantages mentioned as well as those inherent herein. While certain preferred embodiments of the Prefabricated Articulating Pier Cap have been illustrated and described for the purposes of the present disclosure, numerous changes and arrangement in construction of the parts may be made by those skilled in the art, which changes are accomplished within the scope and spirit of the Prefabricated Articulating Pier Cap as defined by the appended claims.

What is claimed is:

1. A support structure for a transportation passageway supported by a column, the support structure comprising:

a bearing having an anchor, a bracket face, and a bearing axis of rotation, the anchor shaped to fix the bearing to the column;

a bracket having a column face and an arcuate face, the column face shaped to rotate about the bearing axis of rotation relative to the bracket face;

a cap having a top and a bottom, the top including at least one beam support and the bottom including an arcuate bottom portion, the arcuate bottom portion shaped to accept the arcuate face of the bracket and having a radial center point defining a cap axis of rotation, the arcuate bottom portion shaped to rotate about the radial center point relative to the arcuate face.

2. The support structure of claim 1, wherein the bearing axis of rotation and the cap axis of rotation are skew.

3. The support structure of claim 1, wherein the bearing axis of rotation and the cap axis of rotation are perpendicular.

4. The support structure of claim 3, wherein the at least one beam support includes a curved surface defining a center of rotation perpendicular to both the bearing axis of rotation and the cap axis of rotation.

5. The support structure of claim 1, wherein the cap, bracket, and bearing are composed of metal.

6. The support structure of claim 1, further including a fastener, the cap including an attachment opening, and the bearing further including a stanchion shaped to traverse the attachment opening and engage the fastener to secure the cap to the bearing and the bracket between the cap and the bearing.

7. The support structure of claim 1, wherein the cap is welded to the bracket and the bracket is operatively welded to the bearing.

8. The support structure of claim 1, wherein:

the bracket further includes at least one pilot pin;

the bearing further includes at least one pilot hole shape to accept the at least one pilot pin.

9. The support structure of claim 1, further including a spacer positioned between the bracket and the bearing and spacing the bracket from the bearing.

10. The support structure of claim 1, wherein cap includes a width and a length having a midpoint, the radial center point of the arcuate bottom portion substantially aligned with the midpoint of the length of the cap.

11. A pier for supporting a transportation passageway on a column, the pier comprising a bearing having a post including an anchor side and a fastener side, a bracket face, and a bearing axis of rotation, the anchor side shaped to fix the bearing to the column:

a bracket having a substantially flat column face and an arcuate face, the column face shaped to rotate about the bearing axis of rotation relative to the bracket face;

a cap having a top and a bottom, the top including a plurality of beam supports and the bottom including an arcuate bottom portion, each beam support including a curved surface defining a center of rotation, the arcuate bottom portion shaped to accept the arcuate face of the bracket and having a radial center point defining a cap axis of rotation, the arcuate bottom portion shaped to rotate about the radial center point relative to the arcuate face; and wherein the bearing axis of rotation, the cap axis of rotation, and the center of rotation of the curved surface of the beam supports are perpendicular.

12. The pier of claim 11, wherein:

the cap, bracket, and bearing are composed of metal; and the cap is welded to the bracket and the bracket is operatively welded to the bearing.

13. The pier of claim 11, further including a fastener, the cap further including an attachment opening, and the bearing further including a stanchion shaped to traverse the attachment opening and engage the fastener to secure the cap to the bearing and the bracket between the cap and the bearing.

14. The pier of claim 11, wherein:

the bracket further includes at least one pilot pin;

the bearing further includes at least one pilot hole shape to accept the at least one pilot pin; and further including a spacer positioned between the bracket and the bearing and spacing the bracket from the bearing.

15. The pier of claim 11, wherein cap includes a width and a length having a midpoint, the radial center point of the arcuate bottom being substantially aligned with the midpoint of the length of the cap.

16. A prefabricated articulating pier for supporting a transportation passageway on a column, the pier comprising:

a bearing having a seat face, a first axis of rotation, and a post including an anchor side and a fastener side, the anchor side shaped to penetrate the column and fix the bearing to the column:

a seat having a substantially flat column face and an arcuate face, the column face shaped to rotate about the first axis of rotation relative to the seat face;

a cap having a top, a width, a length, and a bottom, the top including a plurality of beam supports and the bottom including an arcuate bottom portion, each beam support including a curved surface defining a second axis of rotation, the arcuate bottom portion shaped to accept the arcuate face of the seat and having a radial center point defining a third axis of rotation, the arcuate bottom portion shaped to rotate about the radial center point relative to the arcuate face wherein the length includes a midpoint, the third axis of rotation being substantially aligned with the midpoint of the length of the cap; and wherein the first axis of rotation, the second axis of rotation, and the third axis of rotation are perpendicular.

17. The pier of claim 16, further including a fastener, the cap further including an attachment opening, and the bearing further including a stanchion shaped to traverse the attachment opening and engage the fastener to secure the cap to the bearing and the seat between the cap and the bearing.

18. The pier of claim 17, wherein:

the cap, seat, and bearing are composed of metal; and the cap is welded to the seat and the seat is operatively welded to the bearing.

19. The pier of claim 17, wherein:

the seat further includes at least one pilot pin;

the bearing further includes at least one pilot hole shape to accept the at least one pilot pin; and further including a spacer positioned between the seat and the bearing and spacing the bracket from the bearing.

20. A method of constructing a pier for supporting a transportation passageway on a column, the method comprising:

a. providing a bearing having a first axis of rotation, a bracket having an arcuate face, prefabricated pier cap having a second axis of rotation and beam supports having a third axis of rotation, and beams;

b. fixing the bearing on the column about the first axis of rotation to align the transportation passageway;

c. positioning the bracket on the bearing;

d. positioning the prefabricated pier cap on the bracket;

e. optionally independently adjusting the bracket about the first axis of rotation to align the transportation passageway;

f. optionally independently adjusting the prefabricated pier cap about the second axis of rotation to align the transportation passageway;

g. positioning the beams on the prefabricated pier cap; and h. optionally independently adjusting the beams about the third axis of rotation to align the transportation passageway.

* * * * *